US005550622A

United States Patent [19]

Tange

[11] Patent Number: 5,550,622

[45] Date of Patent: Aug. 27, 1996

[54] FLEXIBLE BLADE CLEANING DEVICE USED IN AN IMAGE FORMING APPARATUS

[75] Inventor: Keigo Tange, Okazaki, Japan

[73] Assignee: Minolta Co., Ltd., Osaka, Japan

[21] Appl. No.: 348,865

[22] Filed: Nov. 29, 1994

[30] Foreign Application Priority Data

Dec. 2, 1993 [JP] Japan ..... 5-302849

[51] Int. Cl.[6] ..... G03G 21/00

[52] U.S. Cl. ..... 355/299; 15/256.5

[58] Field of Search ..... 355/296, 299; 15/256.5–256.52

[56] References Cited

U.S. PATENT DOCUMENTS 4,007,982 2/1977 Stamge ..... 355/299

5,218,412 6/1993 Martin ..... 355/299

5,321,483 6/1994 Yokoyama et al. ..... 355/299

FOREIGN PATENT DOCUMENTS 61-122682 6/1986 Japan .

*Primary Examiner*—William J. Royer

*Attorney, Agent, or Firm*—Burns, Doane, Swecker & Mathis, L.L.P.

[57] ABSTRACT

A cleaning device which has a flexible cleaning blade held by a holder with one end portion thereof so that another end portion contacts with a surface of a photosensitive member. The holder is rotatably connected with a frame about an axis positioned between the one end portion and the another end portion of the cleaning blade so that the pressure contact angle does not change even when the amount of flexion of the cleaning blade changes.

12 Claims, 6 Drawing Sheets

FLEXIBLE BLADE CLEANING DEVICE USED IN AN IMAGE FORMING APPARATUS

BACKGROUND OF THE INVENTION

1. Field of the Invention

The present invention relates to a cleaning device for cleaning residual toner from the surface of a photosensitive member in an image forming apparatus.

2. Description of the Related Art

Cleaning devices for cleaning residual toner from the surface of a photosensitive member in an image forming apparatus are well known which clean said residual toner from the surface of a photosensitive member by means of pressure contact of a cleaning blade with the surface of said photosensitive member. In cleaning devices of the aforesaid type, the modes of pressure contact of the cleaning blade with the surface of the photosensitive member include counter type modes wherein the angle formed between the cleaning blade and the uncleaned surface of the photosensitive member is an obtuse angle, and trailing type modes wherein said angle is an acute angle.

The cleaning efficiency of the aforesaid cleaning blades is generally determined by the characteristics of the material used to form the blade and the various conditions of pressure contact between the blade and the surface of the photosensitive member. Among the conditions of the aforesaid pressure contact, the most important conditions are the setting of the pressure contact force when the cleaning blade makes pressure contact with the photosensitive member, and the setting of the pressure contact angle. The pressure contact angle θ is the angle formed between the cleaning blade and the tangent plane of the photosensitive member.

Conventional cleaning blades are subject to certain disadvantages which occur due to changing environmental factors such as temperature and humidity and changes over time due to localized deformation of the blade and grip of said blade as a result of changes in the blade's Young's modulus which expresses blade hardness, said disadvantages including fluctuation in the amount of flexion Δu of the cleaning blade when said blade comes into pressure contact with the surface of the photosensitive member, thereby causing variation of the pressure contact angle θ.

(The amount of flexion Δu of the cleaning blade is the amount of movement of corner edge P of cleaning blade 1 in pressure contact with the surface of the photosensitive member from an initial position which produces a flexion in said cleaning blade 1, as shown in FIG. 4.) Counter type cleaning blades have disadvantages such as filming and the like which result from retained toner and toner pressed against the surface of the photosensitive member when the pressure contact angle θ changes, and particularly when said angle increases. Trailing type cleaning blades also have disadvantages in addition to deterioration of cleaning efficiency similar to that occurring in counter type cleaning blades, such as noise generation resulting from rubbing against the photosensitive member.

Further disadvantages arise from differences in Young's modulus among individual blades during manufacturing of the cleaning blades, which causes differences in the amount of flexion Δu of individual cleaning blades, and results in a diverse range of cleaning efficiencies even among image forming apparatus of the same type.

SUMMARY OF THE INVENTION

A main object of the present invention is to provide a cleaning device having a cleaning blade which eliminates the previously described disadvantages by providing a cleaning device wherein, when the cleaning blade is in pressure contact with the surface of a photosensitive member, the pressure contact angle θ does not change even when the amount of flexion Δu of the cleaning blade changes due to changes of environmental factors or changes over time, nor does the pressure contact angle θ change even when the amount of turning of the holder supporting the cleaning blade changes.

These objects of the present invention are achieved by providing, in a cleaning device for removing residual toner from a surface of an image bearing member, a cleaning device provided with a flexible cleaning blade along said image bearing member, a holder connected with one end portion of said cleaning blade to contact the other end portion of said cleaning blade with said surface of the image bearing member, a casing in which said holder is provided, and a connective member which rotatably connects said holder with said one end portion and said other end portion of the cleaning blade.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

A first embodiment of the present invention is described hereinafter with reference to the accompanying drawings.

The cleaning device of the present invention is used in image forming apparatus such as copying apparatus, printers, facsimiles and the like, and is a cleaning device for cleaning residual toner from the surface of a photosensitive member by means of pressure contact of a cleaning blade on said photosensitive member.

Figure 1:
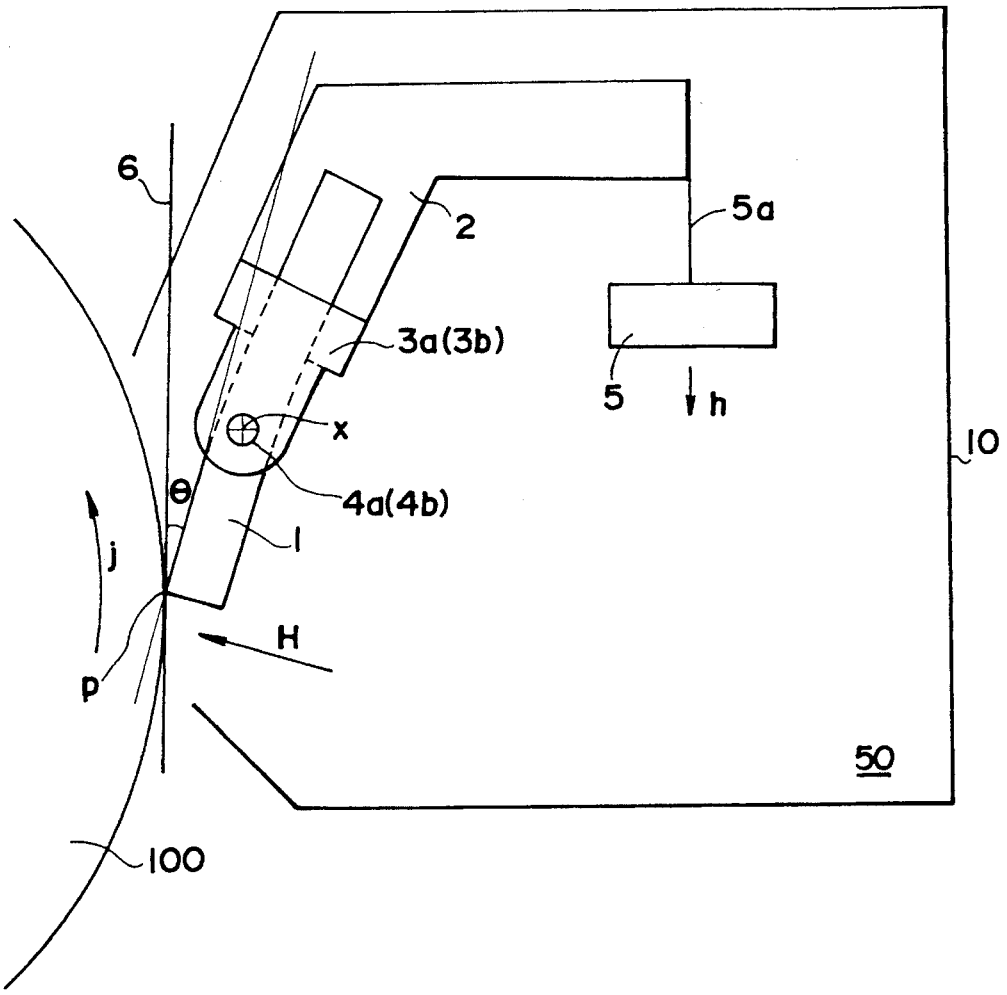
FIG. 1 is a transverse cross section view showing a first embodiment of the cleaning device of the present invention provided with a cleaning blade of a counter type.
Figure 2:
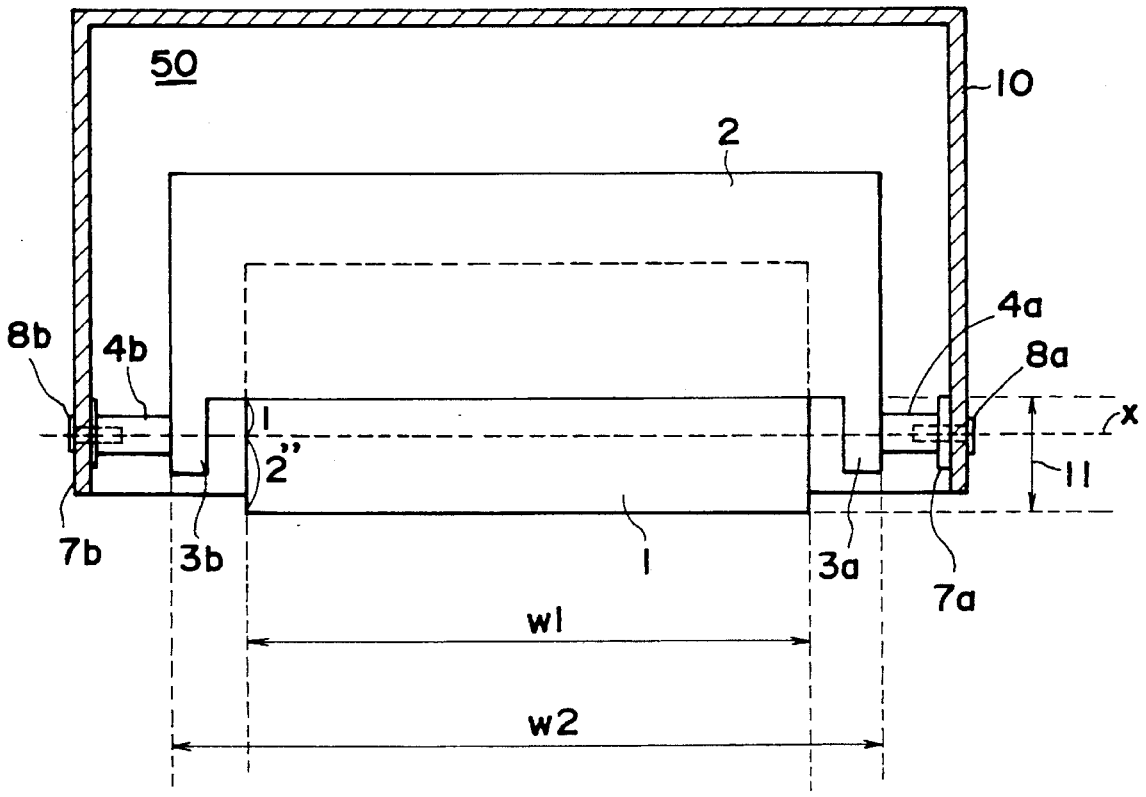
FIG. 2 is a section view showing a first embodiment of the cleaning device of the present invention.

FIG. 1 is a transverse section view showing cleaning device 50 provided with a cleaning blade 1 of the counter type wherein the angle formed between said blade and the uncleaned surface of the photosensitive member 100 is an obtuse angle. FIG. 2 is a section view of cleaning device 50 viewed from above holder 2 supporting cleaning blade 1.

Cleaning device 50 cleans residual toner from the surface of photosensitive member 100 which rotates in the arrow "j" direction. Cleaning device 50 comprises cleaning blade 1 arranged on the inside of box-like casing 10 which is provided with an opening on the side confronting photosensitive member 100, holder 2 for supporting cleaning blade 1, and weight 5 which exerts a force on cleaning blade 1 toward photosensitive member 100.

Cleaning blade 1 is disposed with its lengthwise edge parallel to the rotational axis of photosensitive member 100, and the other edge of the blade on the side opposite photosensitive member 100 is supported by holder 2. The length W1 of cleaning blade 1 in the direction of the aforesaid rotational axis is equal to the width of the image forming range on photosensitive member 100 in the direction of said rotational axis.

Both sides of the holder 2 are provided with arms 3*a* and 3*b* which extend parallel to the lateral edges of cleaning blade 1 in the direction of the photosensitive member 100, and are individually integrated with holder 2. The length W2 of holder 2 including the aforesaid pair of arms 3*a* and 3*b* in the direction of the rotational axis is longer than the length W1 of cleaning blade 1 in the same direction, and is equal to the width of photosensitive member 100 in the direction of the rotational axis.

The cleaning blade 1 and the holder 2 may be formed such that the length W1 of cleaning blade 1 in the direction of the rotational axis of the photosensitive member 100 is equal to the width of photosensitive member 100 in the direction of the rotational axis.

Arms 3*a* and 3*b* are respectively provided with shafts 4*a* and 4*b* which extend to the side of holder 2 and are parallel with the rotational axis of photosensitive member 100 at their respective positions. Shafts 4*a* and 4*b* are fixedly attached from the exterior side of the side wall at shaft bearings 7*a* and 7*b* provided on the side walls of casing 10 such that holder 2 is rotatable via screw members 8*a* and 8*b*. Shafts 4*a* and 4*b* are both arranged on rotational axis X parallel to the rotational axis of photosensitive member 100.

Cleaning blade 1 and blade supporting holder 2 are connected to the side wall of casing 10 via shafts 4*a* and 4*b* so as to rotate about rotational axis X.

As shown in FIG. 2, cleaning blade 1 has a moving portion 11 provided medially to the leading edge portion and the portion supported by holder 2. Arms 3*a* and 3*b* and shafts 4*a* and 4*b* are disposed so as to position their rotational axis X at the center of the thickness of moving portion 11, as well as at a position ⅔ length of the whole length of moving portion 11 distant from the leading edge of blade 1 which makes pressure contact with photosensitive member 100.

A weight 5 is suspended via wire 5*a* from the edge portion of holder 2 which is on the opposite side from photosensitive member 100. Weight 5 exerts a force in the arrow "H" direction on cleaning device 50 about rotational axis X, such that the free end of cleaning blade 1 is pressed against photosensitive member 100.

When cleaning blade 1 is pressed against photosensitive member 100, the corner edge P of cleaning blade 1 makes contact with the surface of photosensitive member 100 parallel to the rotational axis of photosensitive member 100.

Figure 3:
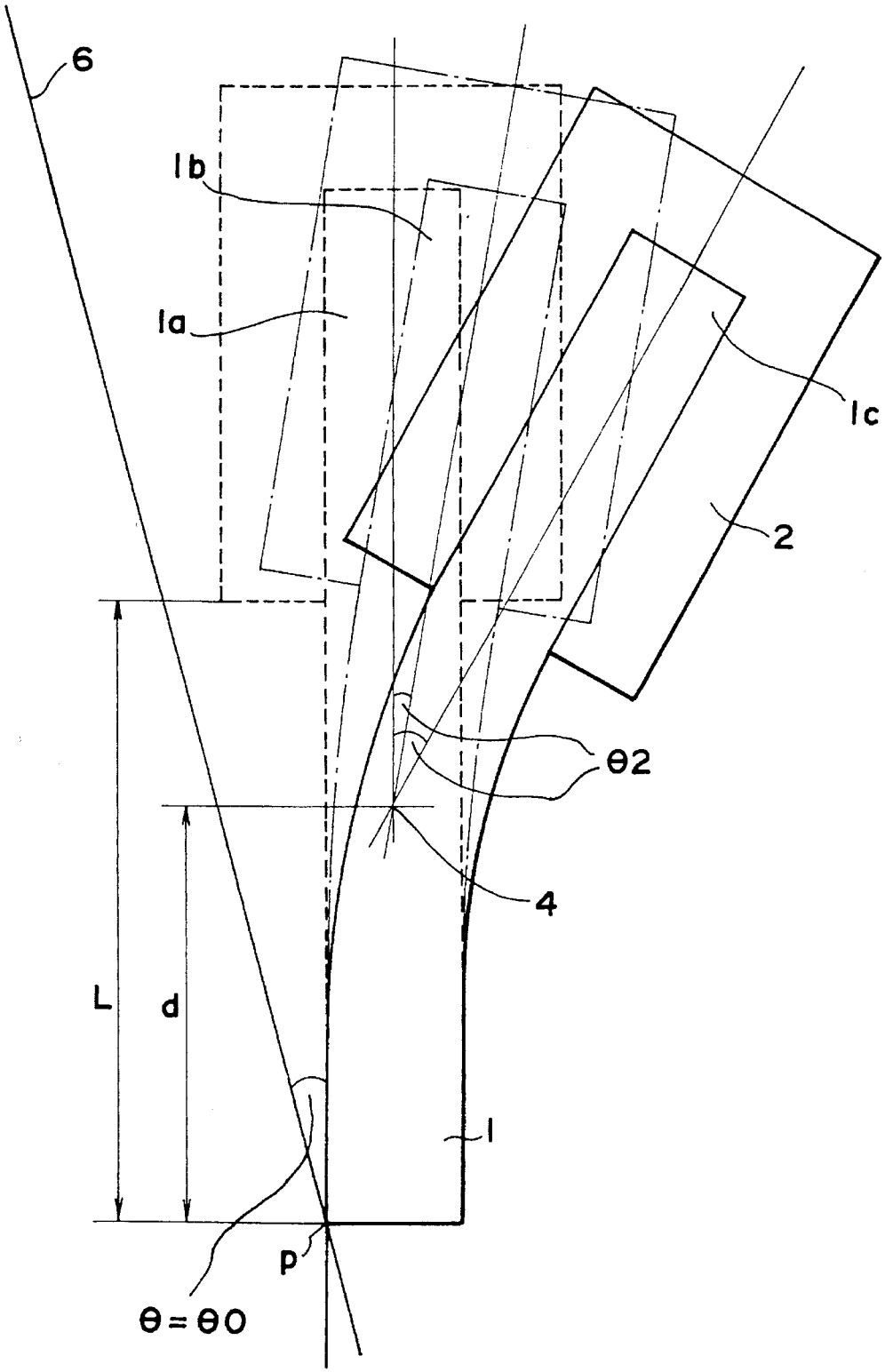
FIG. 3 is an illustration showing the change in the amount of flexion Δu of the cleaning blade when the cleaning blade of the first embodiment of the cleaning device of the invention is in pressure contact with the surface of the photosensitive member.
Figure 4:
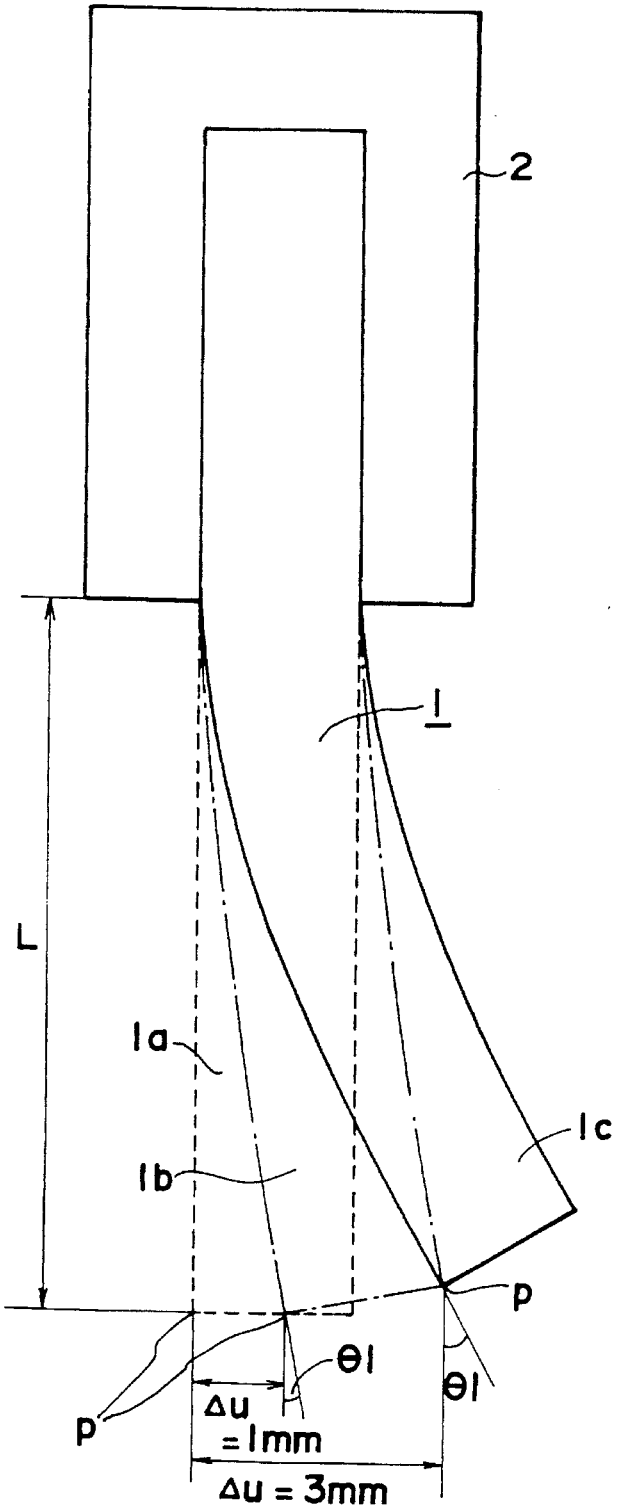
FIG. 4 is an illustration showing the cleaning blade of a first embodiment of the cleaning device of the invention, and further shows the change in the amount of flexion Δu of the cleaning blade when the holder is stationary.

The effects of changes in pressure contact angle θ from line 6 on the position of rotational axis X are discussed below with reference to FIG. 3 and 4. FIG. 3 is an illustration showing changes in the amount of flexion Δu of blade 1 when cleaning blade 1 is in pressure contact with photosensitive member 100. FIG. 4 is an illustration showing change in the amount of flexion Δu when holder 2 is stationary. In FIGS. 3 and 4, broken line a*a* describes cleaning blade 1 when flexion Δu is 0 (zero); dash and dot line a*b* describes cleaning blade 1 when flexion Δu is 1 mm; solid line 1*c* describes blade 1 when flexion Δu is 3 mm. Angle θ1 is the angle formed by the tangent line connecting the surface of blade 1 at corner edge P and the straight line parallel to the surface of blade 1 in its initial state; this angle is hereinafter referred to as "flexion angle θ1." The magnitude of flexion angle θ1 expresses the flexion condition of blade 1. Angle θ2 is the angle of rotation of holder 2 about rotational axis X; this angle is hereinafter referred to as "rotation angle θ2."

The relationship between pressure contact angle θ and rotational axis X is expressed by the equations below.

When flexion Δu is 0 (zero), the initial set angle forming the angle between the surface of cleaning blade 1 confronting photosensitive member 100 and the surface of photosensitive member 100 is expressed as θ0, the pressure contact angle θ can be expressed by Equation (1) below.

$$\theta=\theta 0+\theta 2-\theta 1 \tag{1}$$

Flexion angle θ1 can be expressed by Equation (2) below. This equation approximates length L of moving portion 11, flexion angle θ1, and flexion amount Δu.

$$\theta 1=\tan^{-1}\left(\frac{3}{2}-\frac{\Delta u}{L}\right) \tag{2}$$

Rotational angle θ2 is expressed by Equation (3) below. This equation expresses the relationship between rotational angle θ2 about point 4 and distance d from rotational axis X to the edge of cleaning blade 1.

$$\theta 2=\tan^{-1}\frac{\Delta u}{d} \tag{3}$$

When the aforesaid equations are applied to Equation (1) expressing pressure contact angle θ, the following equation is derived.

$$\theta=\theta 0+\tan^{-1}\frac{\Delta u}{d}-\tan^{-1}\left(\frac{3}{2}-\frac{\Delta u}{L}\right) \tag{4}$$

In the cleaning device of the present invention, rotational axis X may be determined with pressure contact angle θ equal to the initial set angle θ0 because pressure contact angle θ0 does not change even when flexion amount Δu changes, i.e., even when the flexion of moving portion 11 is great so as to change flexion angle θ1. Thus, applying θ=θ0 to the aforesaid Equation (4), derives the following equation.

$$\frac{\Delta u}{d}=\frac{3}{2}-\frac{\Delta u}{L}$$

$$d=\frac{2L}{3}$$

It can be understood from the previously described equations that when distance d from rotational axis X to the edge of cleaning blade 1 is ⅔ the length of moving portion 11, pressure contact angle θ is normally maintained at an angle equal to the initial set angle θ0 of cleaning blade 1.

Just as when rotational axis X is positioned ⅔ length of the whole length of moving portion 11 distant from the leading edge of moving portion 11, when the rotational axis X is positioned between the stationary end of cleaning blade 1 supported by holder 2 and the free end of said blade 1 in pressure contact with photosensitive member 100, even if flexion amount Δu increases, not only pressure contact angle θ changes as previous, but also the stationary end, i.e., holder 2 rotates. Since the rotation of holder 2 offsets the change of pressure contact angle θ, the influence of the changes in flexion amount Δu on changes in pressure contact angle θ is reduced.

Accordingly, in the present embodiment, holder 2, arms 3*a* and 3*b*, shaft holes 7*a* and 7*b* are arranged so as to position rotational axis X at a position ⅔ length of the whole length of moving portion 11 distant from the edge of cleaning blade 1. However, the present invention is not limited to the construction of the present embodiment, and if rotational axis X is positioned medially to the stationary end and the free end of blade 1, the change in pressure angle θ is effectively reduced even when flexion Δu increases.

Figure 5:
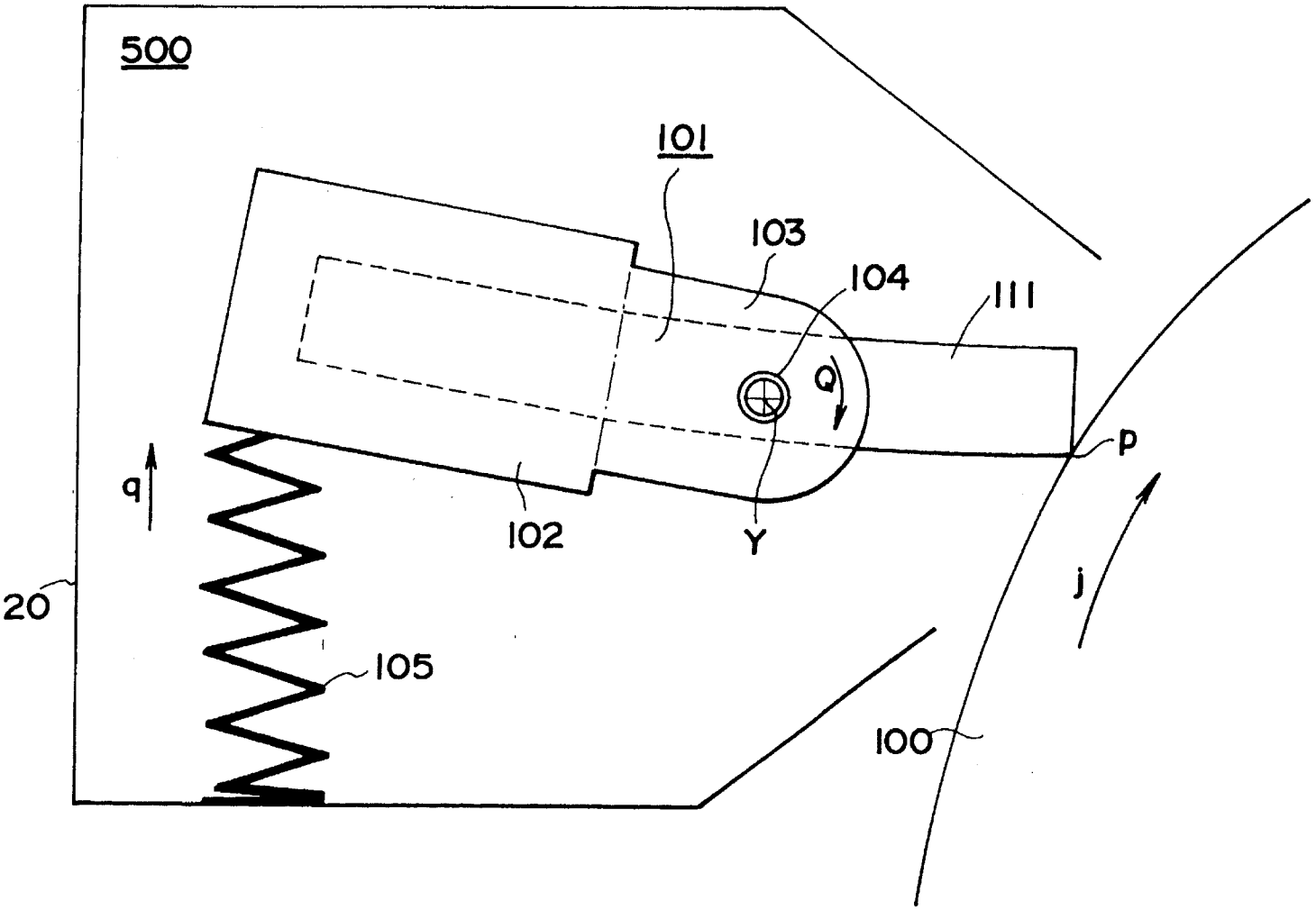
FIG. 5 is a section view showing a second embodiment of the cleaning device of the present invention provided with a cleaning blade of a trailing type.
Figure 6:
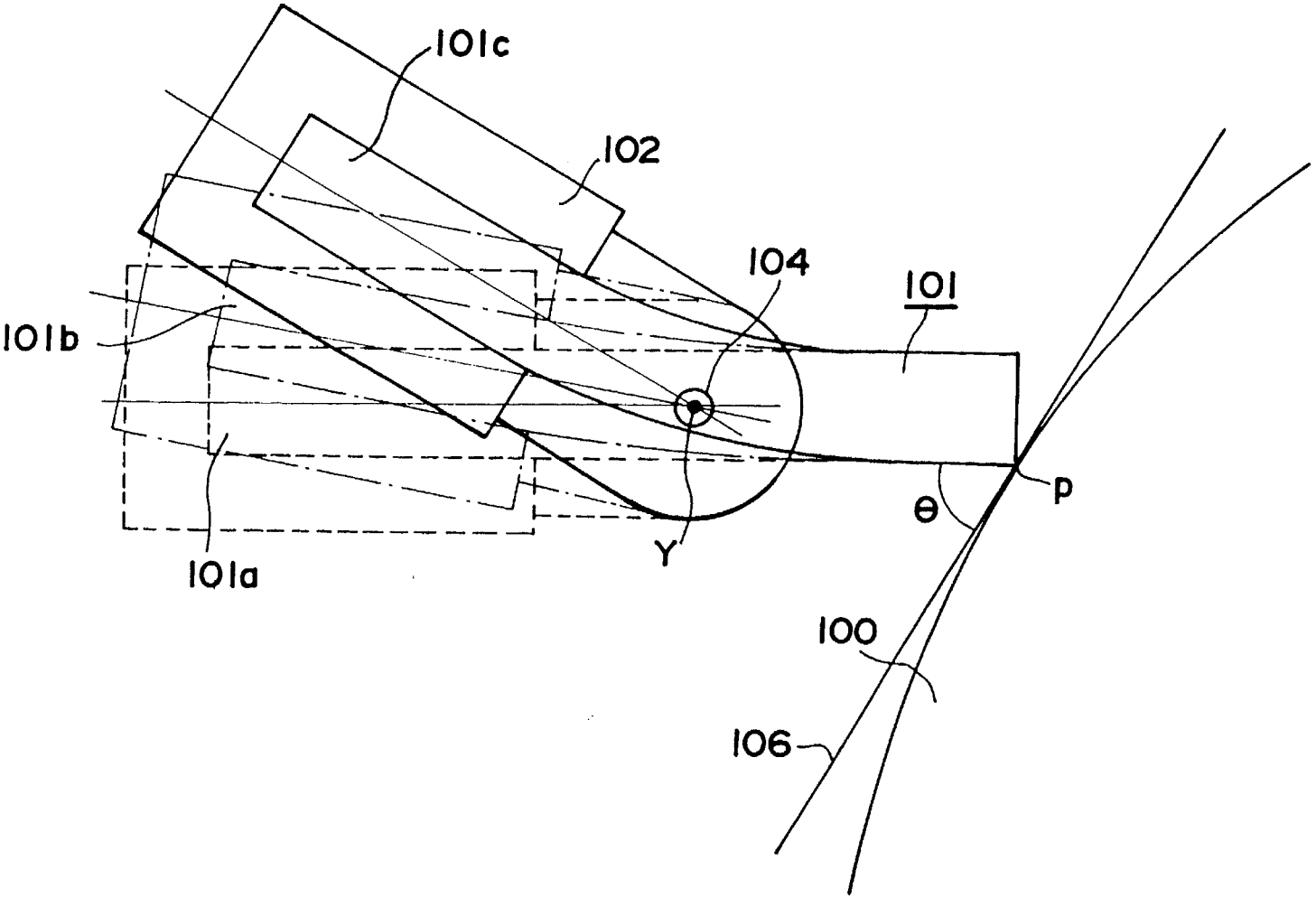
FIG. 6 is an illustration showing the change in the amount of flexion Δu of the cleaning blade provided in the second embodiment of the cleaning device of the present invention.

A second embodiment of the present invention is described hereinafter with reference to FIGS. 5 and 6. The cleaning device of the second embodiment is a trailing type cleaning device wherein the cleaning blade makes pressure contact with the uncleaned surface of photosensitive member 100 at an acute angle. FIG. 5 is a side view of cleaning device 500. FIG. 6 is an illustration showing the change in flexion Δu of cleaning blade 101.

Cleaning device 500 comprises cleaning blade 101, holder 102, and spring member 105 which exerts a force on holder 102 in the arrow "q" direction arranged within box-like casing 20 provided with an opening in the surface confronting photosensitive member 100.

Cleaning blade 101 is arranged lengthwise parallel to the rotational axis of photosensitive member 100 (not shown in the drawings) which rotates in the arrow "j" direction, such that one edge of said blade 101 is arranged so as to make contact with the surface of photosensitive member 100. The other edge of cleaning blade 101, i.e., the edge on the side opposite photosensitive member 100, is supported by holder 102.

A pair of arms 103 are integratedly provided bilaterally on holder 102. Arms 103 extend in the direction of photosensitive member 100 parallel to the side edges of cleaning blade 101. The arms 103 are provided with individual shaft members 104, such that cleaning device 500 is rotatably supported at the sides of casing 20 via said shaft members 104. Shaft members 104 are provided on rotational axis Y, which is an axis parallel to the rotational axis of photosensitive member 100 (not shown in the drawings). When the portion of cleaning blade 101 disposed medially to the leading edge portion and the portion supported by holder 102 is a moving portion 111, the aforesaid arms 103 and shaft members 104 are positioned at the center thickness of moving portion 111, and at a position ⅔ of the distance from the leading edge of moving portion 111.

A spring member 105 which exerts a force on holder 102 in the arrow "q" direction is provided medially to the posterior edge of holder 2 and casing 20. Cleaning device 500 moves in the arrow "Q" direction about rotational axis Y via the force exerted by the spring member 105 in the arrow "q" direction, such that the corner edge P of cleaning blade 101 makes pressure contact with the surface of photosensitive member 100 parallel to the rotational axis of said photosensitive member 100. At this time, the angle formed between the uncleaned surface of photosensitive member 100 and cleaning blade 101 is an acute angle, and the angle formed by the surface of cleaning blade 101 confronting photosensitive member 100 and contact plane 106 of photosensitive member 100 is pressure contact angle θ.

In FIG. 6, broken line 101*a* and dash and dot line 101*b*, and solid line 101*c* respectively describe cleaning blade 101 when flexion Δu is 0 (zero), 1 mm, and 3 mm. In the present embodiment, the various members and components of cleaning device 500 are arranged such that rotational axis Y is positioned ⅔ length of the whole length of moving portion 111 distant from the leading edge of moving portion 111. Therefore, pressure contact angle θ formed by cleaning blade 101 and contact plane 106 of photosensitive member 100 is uniformly maintained even when flexion A Δu changes, just as in the previously described embodiment of the counter type cleaning device. Thus, cleaning efficiency is normally stable.

Although cleaning blade 101 is used as the member making pressure contact with the surface of photosensitive member 100, and spring member 105 is used, it is to be understood that other components may be alternatively used.

As previously described, the cleaning device of the present invention maintains a uniform pressure angle θ of the cleaning blade in pressure contact with the surface of the photosensitive member regardless of changes in the amount of flexion Δu of the cleaning blade and changes in the amount of rotation of the holder supporting the cleaning blade due to fluctuation of environmental factors or changes over time by arranging various components such that the rotational axis is positioned in the leading edge portion of the cleaning blade not supported by the holder. As a result, filming caused by toner pressed into the surface of the photosensitive member and retained toner do not occur. Furthermore, noise caused by rubbing of the cleaning blade and the photosensitive member does not occur.

Furthermore, differences in Young's modulus among individual blades during manufacturing of the cleaning blades, which causes differences in the amount of flexion Δu of individual cleaning blades and results in a diverse range of cleaning efficiencies even among image forming apparatus of identical types does not occur.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A cleaning device for removing residual toner from a surface of an image bearing member, said cleaning device comprising:

a flexible cleaning blade disposed along said image bearing member;

a holder connected with one end portion of said cleaning blade to contact another end portion of said cleaning blade with said surface of the image bearing member;

a casing in which said holder is provided; and a connecting member which rotatably connects said holder with said casing about an axis positioned between said one end portion and said another end portion of the cleaning blade.

2. A cleaning device according to claim 1, wherein said axis is positioned at a position ⅔ length of the whole length of said blade distant from said another end portion of the cleaning blade.

3. A cleaning device according to claim 1, wherein said axis is positioned at the center of the thickness of said cleaning blade.

4. A cleaning device according to claim 1, wherein said axis is positioned at the center of the thickness of said cleaning blade, as well as, at a position ⅔ length of the whole length of a portion not supported by said holder distant from said another end portion of said cleaning blade.

5. A cleaning device as claimed in claim 1, wherein a distance between said one end portion of the cleaning blade and the axis is shorter than that between said another end portion and the axis.

6. A cleaning device according to claim 1, wherein said connecting member includes a pair of arms integrally provided on said holder, each of said arms extending parallel to a lateral edge of the cleaning blade to connect its leading end with said casing.

7. A cleaning device which removes residual toner from the surface of a rotatable photosensitive member comprising:

a flexible cleaning blade which is disposed with its leading edge parallel to a rotational axis of the photosensitive member such that said leading edge is disposed so as to be in contact with the surface of said photosensitive member;

a holder for supporting another edge of the cleaning blade;

a casing for covering said cleaning blade and said holder; and a connective member for connecting the holder to the casing so as to rotate about an axis positioned on the cleaning blade.

8. A cleaning device according to claim 7, wherein the length of the cleaning blade in the direction of the rotational axis is equal to width of an image forming area on the photosensitive member in the direction of said rotational axis.

9. A cleaning device which removes residual toner from the surface of a rotatable photosensitive member comprising:

a flexible cleaning blade which is disposed with its leading edge parallel to a rotational axis of the photosensitive member such that said leading edge is disposed so as to be in contact with the surface of said photosensitive member;

a holder for supporting another edge of the cleaning blade;

a casing for covering said cleaning blade and said holder; and a connective member for connecting the holder to the casing so as to rotate about an axis which is positioned at a position corresponding to a portion of the cleaning blade not supported by said holder.

10. A cleaning device for removing residual toner from a surface of an image bearing member, said cleaning device comprising:

a flexible cleaning blade having one end portion to be contacted onto the image bearing member; and a holder which is connected with another end portion of said cleaning blade and has a connecting portion to rotate said cleaning blade about an axis positioned between said one end portion and said another end portion thereof.

11. A cleaning device as claimed in claim 10, wherein a distance between said one end portion of the cleaning blade and the axis is shorter than that between said another end portion and the axis.

12. A cleaning device as claimed in claim 10, wherein said connecting portion is protruded from said holder toward said one end portion of the cleaning blade.

* * * * *